US006769764B2

(12) United States Patent
Barinaga et al.

(10) Patent No.: US 6,769,764 B2
(45) **Date of Patent: *Aug. 3, 2004**

(54) REJUVENATION STATION AND PRINTER CARTRIDGE THEREFORE

(75) Inventors: Louis C Barinaga, Salem, OR (US); Gregory W Blythe, Philomath, OR (US); Ashley E Childs, Corvallis, OR (US); Michael J Allison, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/238,385

(22) Filed: Sep. 9, 2002

(65) Prior Publication Data

US 2003/0011666 A1 Jan. 16, 2003

Related U.S. Application Data

(63) Continuation of application No. 09/814,329, filed on Mar. 2, 2001, now Pat. No. 6,478,415.

(51) Int. Cl.[7] ..... B41J 2/175
(52) U.S. Cl. ..... 347/85
(58) Field of Search ..... 347/7, 85, 86, 347/78, 108

(56) References Cited

U.S. PATENT DOCUMENTS 5,578,813 A 11/1996 Allen et al. ..... 250/208.1
5,631,681 A 5/1997 Klaus et al. ..... 347/85
5,644,139 A 7/1997 Allen et al. ..... 250/557
5,778,347 A 7/1998 Hetzer ..... 705/408
5,841,454 A 11/1998 Hall et al. ..... 347/87
5,842,793 A 12/1998 Katayama et al. ..... 400/88
5,844,579 A * 12/1998 Barinaga et al. ..... 347/7
5,848,849 A 12/1998 Kishi et al. ..... 400/88
5,853,251 A 12/1998 Imai ..... 400/88
5,880,448 A 3/1999 Hetzer et al. ..... 235/383
5,887,992 A 3/1999 Yamanashi ..... 400/88
5,905,518 A * 5/1999 DeFilippis ..... 347/86
5,927,872 A 7/1999 Yamada ..... 400/88
5,971,521 A 10/1999 Bainvel et al. ..... 347/32
5,975,689 A 11/1999 Pawlowski, Jr. et al. ..... 347/85
5,988,900 A 11/1999 Bobry ..... 400/88
5,994,710 A 11/1999 Knee et al. ..... 250/557
6,042,216 A 3/2000 Garcia et al. ..... 347/29
6,168,258 B1 1/2001 Lou et al. ..... 347/33
6,234,626 B1 * 5/2001 Axtell et al. ..... 347/108
6,478,415 B2 * 11/2002 Barinaga et al. ..... 347/85
6,488,368 B2 * 12/2002 Petersen et al. ..... 347/85

* cited by examiner

*Primary Examiner*—Anh. T. N. Vo

(57) ABSTRACT

A rejuvenation station has a housing with a first area adapted to hold a fluid supply, and a second area adapted to hold a printer cartridge. In the first area is a first fluidic interconnect that is adapted to couple with the fluid supply. In the second area is a second fluidic interconnect that is adapted to couple with the printer cartridge. A fluid path in the housing couples the fluidic interconnects. An actuator extracts fluid from at least one of the fluid supply and the printer cartridge, and inserts fluid into the printer cartridge through the fluid path.

19 Claims, 12 Drawing Sheets

REJUVENATION STATION AND PRINTER CARTRIDGE THEREFORE

CROSS REFERENCE TO THE RELATED APPLICATION(S)

This is a continuation of application Ser. No. 9/814,329 filed on Mar. 21, 2001 now U.S. Pat No. 6,478,415 which is hereby incorporated by reference herein.

FIELD OF THE INVENTION

This invention relates to printer cartridges. More particularly, this invention is a printer cartridge and a rejuvenation station for the printer cartridge.

BACKGROUND OF THE INVENTION

One common type of inkjet printer uses a replaceable print cartridge. The replaceable print cartridge contains a printhead and a supply of ink. Often, the print cartridge is not intended to be refillable with ink. Accordingly, when the initial supply of ink is depleted, the print cartridge is replaced; the cartridge is disposed of and a new print cartridge is installed within the scanning carriage.

Frequent replacement of the print cartridge results in a relatively high operating cost. In the cartridge, the printhead is the most relatively expensive component. However, sometimes the printhead has a useable life, which can be significantly longer than the time it takes to deplete the ink within the print cartridge. Accordingly, the printhead is capable of being reused with a refill of ink in the ink supply component of the print cartridge. Because less waste is created, reusing the printhead is environmentally desirable, as well as economical.

Often the print cartridges are refilled intermittently by creating an opening through the print cartridge and automatically refilling the print cartridge with ink. Typically an ink reservoir inside the printer is connected to the print cartridge via a tube or other fluidic connections to refill the ink. Such internal ink supplies, that move with the cartridge, are referred to as on-axis ink supplies. However, the on-axis ink supplies take up significant space, which increases the size of the overall printer. Generally, it is desirable to have the printer take up a minimal amount of space.

Alternatively, the print cartridges are refilled intermittently by creating an opening through the print cartridge and refilling the print cartridge with ink. An external, stationary ink reservoir, such as a flaccid bag containing ink, connected to the scanning print cartridge via a tube is typically provided to refill the ink. Such external ink supplies that don't move with the print cartridge are referred to as off-axis ink supplies. Due to the size of the off-axis ink supplies, including routing of the fluid connections, such as tubes, the minimal size of the printer is significantly increased.

Extended use of the same print cartridge using either refill method creates certain problems. Air bubbles grow in an ink manifold through diffusion and can, upon reaching a certain volume, block flow to the printhead causing print quality defects. Air bubbles may even pressurize the print cartridge during an excursion in the temperature or pressure of the ambient environment from normal operating conditions. In particular, during operation, cool ink flows into the ink manifold and is warmed as it flows toward the printhead. Further, the printhead generates heat as its heater resistors are fired to eject droplets of ink from nozzles. For primarily water-based inks, the solubility of air in ink decreases as the ink is heated. As a result, air is driven out of the solution and coalesces with any preexisting bubbles in the manifold. Moreover, because the warmed ink is expelled from the nozzles and replaced with cool ink, there is a steady supply of air from the warming of the ink that coalesces with the preexisting bubbles in the manifold. Additionally, air from the ambient atmosphere can diffuse into preexisting bubbles in the manifold due to a difference in the partial pressure of water vapor in the bubbles and the ambient environment. Eventually, the entire manifold will fill with air.

Another problem caused by extended use of the same print cartridge includes a build-up of paper dust and other fibers on the printhead, which may cause print quality defects when combined with ink mist and dragged across the media during printing.

Often print cartridges have an internal pressure regulator for regulating the flow of ink from an external source into an ink chamber within the print cartridge. Print cartridges with the internal pressure regulator incorporate a diaphragm in the form of a bag. The inside of the bag is open to the atmosphere. The expansion and contraction of the bag controls the flow of ink into the print cartridge to maintain a relatively constant back pressure at the printhead. However, when roughly 5 cc's of air have accumulated in the body and manifold of the print cartridge, the regulator no longer has the capacity to maintain negative pressure. At that point, air in the printhead renders any pressure regulator internal to, or leading to, the print cartridge in a non-functional state. As a result, the back pressure is lost, or the print cartridge is even pressurized (during a temperature or pressure excursion in the ambient environment), and ink drools out of the printhead. A drooling printhead is capable of causing permanent damage to the printer. Moreover, a drooling printhead provides unacceptable print quality. Therefore, the accumulation of excessive air in the body and manifold of print cartridges shortens the useful life of permanent and semi-permanent printheads.

An economical, efficient and compact method for refilling a print cartridge, while maintaining high print quality, is desired.

SUMMARY OF THE INVENTION

A rejuvenation station of the present invention rejuvenates a printer cartridge. The rejuvenation station has a housing with a first area adapted to hold a fluid supplier, and a second area adapted to hold the printer cartridge. In the first area is a first fluidic interconnect that is adapted to couple with the fluid supplier. In the second area is a second fluidic interconnect that is adapted to couple with the printer cartridge. A fluid path in the housing couples the fluidic interconnects. An actuator or pump extracts fluid from at least one of the fluid supplier and the printer cartridge, and inserts fluid into the printer cartridge through the fluid path.

DETAILED DESCRIPTION

Rejuvenation Station

Figure 1:
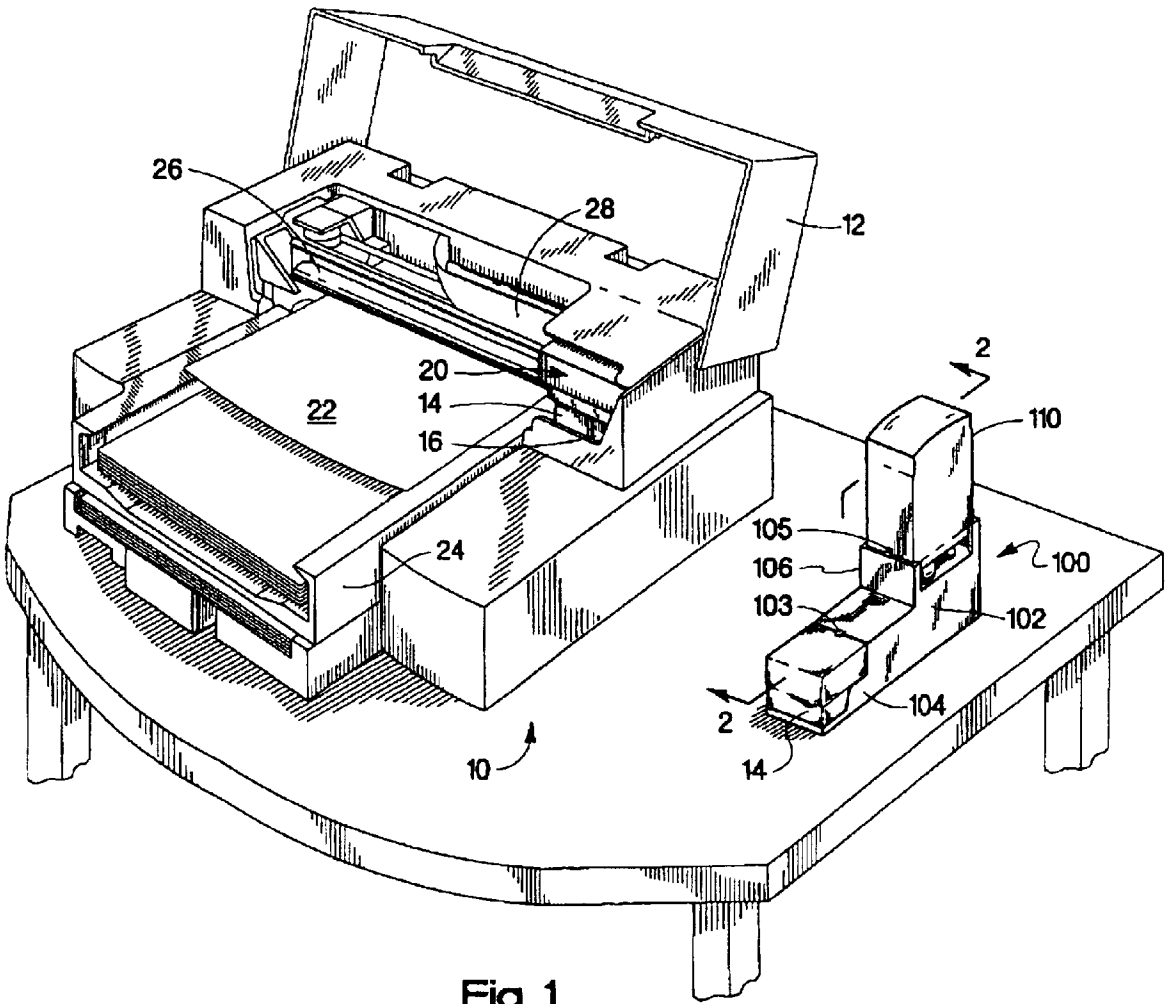
FIG. 1 illustrates a perspective view of a rejuvenation station of the present invention adjacent a printer.

FIG. 1 illustrates a perspective view of a rejuvenation station 100 of the present invention adjacent a printer 10. The printer 10 includes a cover 12, a media tray 24 for receiving print media 22, and a scanning carriage 20 that is moved relative to the print media 22 to accomplish printing. The printer 10 is shown with the cover 12 open.

In the embodiment shown, the scanning carriage 20 slides along a slide rod 26 and carries two replaceable printhead cartridges 14, 16, with one single color printhead cartridge 14 for printing black ink, and one multi-color printhead cartridge 16 for printing multiple colors such as cyan, magenta and yellow ink. As the print media 22 is moved through the printer, the scanning carriage 20 slides to move the printhead cartridges 14, 16 relative to the print media 22. In operation, the inkjet printhead cartridges 14, 16 deposit fluid, such as ink, onto the print media 22. Electrical signals are provided to the scanning carriage 20 for selectively activating printheads of the printhead cartridges 14, 16 via an electrical link, such as a ribbon cable 28. As fluid is ejected from the printhead cartridges 14, 16, the printhead cartridges 14, 16 are depleted of fluid.

In the embodiment shown, the printer cartridge 14 is positioned in the rejuvenation station 100. The rejuvenation station 100 has at least one fluid reservoir (or fluid supplier) 110 and enables fluid to flow from the fluid reservoir 110 to refill the fluid depleted from the printer cartridges. The rejuvenation station has a docking area 104 adapted for receipt of the printhead cartridges 14, 16, and a docking area 106 adapted for receipt of fluid reservoirs 110. The docking areas 104, 106 structurally hold the printhead cartridges and the fluid reservoirs, respectively, for hands-free operation of the rejuvenation station.

Figure 2A:
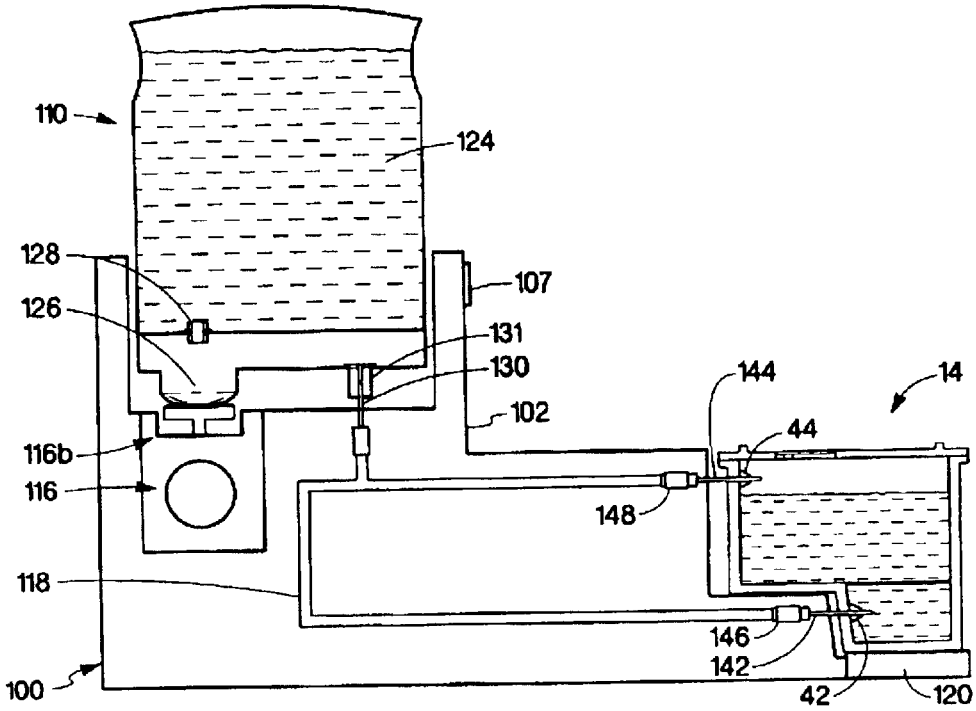
FIG. 2*a* illustrates a cross-sectional view of the rejuvenation station through section 2—2 of FIG. 1.
Figure 2B:
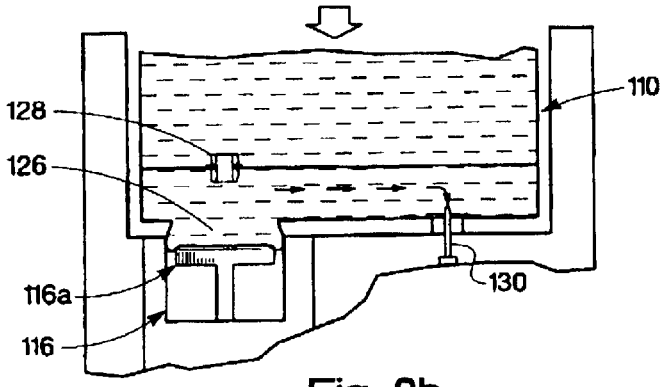
FIG. 2*b* illustrates the pump of FIG. 2*a* in the first position.

As shown in FIGS. 2*a* and 2*b*, the printhead cartridge 14 and the fluid reservoir 110 are fluidically coupled to the rejuvenation station through fluidic interconnects 130, 142, 144 on the rejuvenation station. The fluidic interconnect 130 is adjacent the docking area 106, while the exit fluidic interconnect 142, and the entrance fluidic interconnect 144 are adjacent the docking area 104. The fluid reservoir 110 has a fluidic interconnect 131 that is adapted to couple with the fluidic interconnect 130 of the rejuvenation station. Fluid is able to flow in two directions, both to and from the reservoir 110 through the fluidic interconnects 130, 131.

The printer cartridge 14 has an entrance fluidic interconnect 44 that is adapted to couple with the entrance fluidic interconnect 144 of the rejuvenation station. The printer cartridge 14 has an exit fluidic interconnect 42 that is adapted to couple with the exit fluidic interconnect 142 of the rejuvenation station. The fluidic interconnects 42, 44 are described in more detail below.

The rejuvenation station has a housing 102, and a fluid path 118 within the housing through which fluid flows between the fluid reservoir 110 and the printer cartridge 14. In one embodiment, the fluid path 118 is tubing that connects the fluidic interconnects 130, 142, 144 of the rejuvenation station. The rejuvenation station has an entrance valve 148 along the fluid path adjacent the entrance fluidic interconnect 144 and an exit valve 146 along the fluid path adjacent the exit fluidic interconnect 144. The valves 148, 146 regulate the fluid flow to and from the printer cartridge 14, respectively. In one embodiment, the exit valve 146 is a one way valve that controls fluid flow and extracts fluid from the printer cartridge. In one embodiment, the entrance valve 148 is a one way valve that controls fluid flow and inserts fluid into the printer cartridge.

The fluid reservoir 110 has a fluid chamber (or fluid supply) 124, a pressure chamber 126, and a reservoir valve 128 fluidically coupling the chambers 124, 126. The reservoir valve 128 regulates the flow from the fluid chamber 124 to the pressure chamber 126.

In one embodiment, a refill container (not shown) is inside of the fluid chamber 124 of the fluid reservoir 110. The refill container is made of a crushable or collapsible impervious material, such as aluminum, plastic or an impervious foil. In keeping with the underlying purpose of refilling the printhead cartridge, which is to promote the reuse of cartridges and to thereby help reduce waste requiring disposal, the refill or supply container is made from a single, fully recyclable material. Thin-walled crushable aluminum is suitable for the purpose. The aluminum is fashioned into a small canister of suitable dimensions to enclose an interior volume of 15–18 ml. Because it is desired to squeeze and partially crush container during the fluid refilling process, a bellows-like sidewall structure is provided on the container. The pleated or bellows-like contours (not shown) make container uniformly crushable when force is exerted downwardly on the top of the container. In one embodiment, the reservoir 110 is a conventional fluid refill cartridge or reservoir, such as the fluid refill cartridges that are used in Hewlett Packard's line of printers.

The rejuvenation station has a pump or actuator 116 that activates the fluid reservoir 110 to pump fluid through the fluid path. The actuator 116 creates an oscillating pressure to extract fluid from at least one of the fluid reservoir and the printer cartridge, and to insert fluid into the printer cartridge.

As shown in FIG. 2*b*, when the pump 116 is in a first position 116*a*, the pump pushes on the pressure chamber 126, thereby creating a positive pressure impulse and pushing the fluid contents of the pressure chamber out the fluidic interconnect 130, 131. The pump 116 then creates a vacuum in the pressure chamber 126 or a negative pressure impulse by moving to a second position 116*b*, as shown in FIG. 2*a*. As the pump 116 is moved from the position shown in FIG. 2*b* to the position shown in FIG. 2*a*, the pressure chamber 126 sucks fluid into the pressure chamber which acts as a vacuum, as described in more detail below. The pump then returns to position 116*a* to push onto the pressure chamber, and the process is repeated. The pump alternates between the positions shown in FIGS. 2*a* and 2*b*.

While the pressure chamber 126 is under pressure through actuation of the pump 116 from the first position 116*a* to the second position 116*b*, fluid (including air) is sucked out from the exit fluidic interconnect 42 of the printer cartridge 14 and sucked into the pressure chamber 126. At a first predetermined pressure or upon the negative pressure impulse created, the exit valve 146 is opened to allow fluid to flow into the fluid path 118 (which is in fluidic communication with the pressure chamber) and into the pressure chamber 126. Fluid (including air) is then sucked out from the exit fluidic interconnect 42 of the printer cartridge 14 and into the pressure chamber 126. The exit valve 146 remains open until the pressure chamber reaches a first certain pressure, and then the exit valve 146 closes.

In one embodiment, at a second predetermined pressure the reservoir valve 128 is opened to allow fluid to flow into the pressure chamber 126 from the fluid chamber 124. The pressure chamber 126 is under a second predetermined pressure that is higher than the first predetermined pressure. Generally, the reservoir valve 128 opens when the cartridge is at least partially empty. Due to the depleted state, the fluid in the cartridge is generally unable to provide the total fluid volume and/or the fluid velocity to fill up the increasing void in the pressure chamber with fluid, when the pump is moved from the first position 116*a* to the second position 116*b*. Accordingly, the reservoir or supply valve 128 opens at a pressure, which is greater than the pressure which causes the exit valve 146 to open.

The reservoir valve 128 remains open until the pressure chamber is filled and the pump reaches the position in FIG. 2*a*, and then the valve 128 closes. In one embodiment, the pressure chamber 126 at this point is filled with fluid and/or gas from the printer cartridge and/or the fluid reservoir.

The exit valve 146 opens when the pressure is in a range of about 1 to 25 inches of water (about 2 to 47 mm of Hg). In one embodiment the range of the opening pressure is at about 8 to 15 inches of water (about 15 to 28 mm of Hg).

The reservoir valve 128 opens when the pressure is in a range of about 10 to 50 inches of water (about 19 to 93 mm of Hg). It is desired that the opening pressure of valve 128 is greater than the opening pressure of valve 146. In one embodiment the range of the opening pressure is at about 20 to 30 inches of water (about 37 to 56 mm of Hg). In another embodiment, the opening pressure is at about 25 inches of water (about 47 mm of Hg).

When the pressure chamber 126 is pressurized from moving the pump 116 from position 116*b* to position 116*a*, fluid (including air) is pushed out from the pressure chamber 126 and into the entrance fluidic interconnect 144 of the printer cartridge. When the pump is pressed, and the positive pressure impulse is created, the entrance valve 148 opens. The entrance valve 148 remains open until a certain pressure is detected in the fluid path, and then the entrance valve 148 closes. The entrance valve 148 generally closes upon creation of the negative pressure impulse from the pump.

The entrance valve 148 opens when the pressure is in a range of about 0 to 70 inches of water (about 0 to 130 mm of Hg). The range is set by a desire to prevent backflow on the low end, and limiting the pressure of the seals on the high end. In one embodiment the range of the opening pressure is at about 8 to 12 inches of water (about 15 to 22 mm of Hg). In another embodiment, the opening pressure is at about 10 inches of water (about 19 mm of Hg).

In one embodiment, the inside diameters of areas having fluid flow in the fluid circuit 118 ranges from about 1 to 2 mm.

The fluid moves in the fluid path in a fluid circuit from the exit fluidic interconnect 142, through the exit valve 146. The fluid then moves through the fluid path 118 and through the reservoir fluidic interconnect 130, 131 to the pressure chamber 126 of the fluid reservoir 110. The fluid is pushed back through the fluidic interconnect 130, 131, through the entrance valve 148 and to the entrance fluidic interconnect 144.

The cycle of the fluid through the fluid circuit 118 continues as the pump moves between the positions shown in FIGS. 2*a* and 2*b*. After a certain period of time, or after a certain number of cycles, depending upon the initial fluid level in the cartridge, an end cycle is reached which indicates that the cartridge 14 is filled with the fluid. In one embodiment, when mass flow rate through the return or fluid path 118 creates a pressure such that the difference in pressure between the pump pressure and the pressure in the fluid path is less than pressure that reservoir valve 128 is set to open, then the cartridge is full. In this embodiment, the reservoir valve 128 generally does not open because there is sufficient fluid volume and/or fluid velocity from the cartridge to fill the pressure chamber when the pump is in position 116*b*. The fluid is then in a closed system. Fluid is thereby recirculated from the printer cartridge through the fluid path to the pressure chamber, back to the fluid path and into the printer cartridge.

When this end cycle is reached, and the reservoir valve 128 remains closed in successive cycles, it is desirable that the pump 116 terminates operation. In one embodiment, the pump automatically turns off upon reaching the end cycle. In another embodiment, the pump continues oscillating between positions 116*a* and 116*b* until turned off manually, or later automatically, such as by a timer.

In one embodiment, the rejuvenation station has an indicator 107 as shown in FIG. 2*a*. The indicator 107 indicates the number of times that a particular cartridge has been refilled using a memory (not shown). In another embodiment, after the indicator indicates that the cartridge has been refilled a certain number of times, the pump does not engage to refill the cartridge again. In this embodiment, the indicator indicates to the user that a new cartridge needs to be purchased. Typically, the indicator has a warning system to indicate to the user the number of refills for that cartridge and/or the life expectancy of the cartridge. Alternatively or additionally, the indicator 107 is located on the cartridge 14.

In another embodiment, the indicator 107 alternatively or additionally indicates the fluid level inside the cartridge. However, in this invention, the rejuvenation station 100 functions optimally even without the indicator 107 indicating the fluid level. The recirculating process of the rejuvenation station 100 described above rejuvenates the cartridge to a set level, even when the cartridge is initially at any fluid level. The user may desire to recharge or rejuvenate the cartridge before long printing cycles, or before traveling with a roving or mobile printer, as described below in FIG. 12. The cartridge is rechargeable at any fluid level. The cartridge may even be full when the cartridge is placed in the rejuvenation station for rejuvenation.

In yet another embodiment, the indicator 107 alternatively or additionally indicates that the pen cartridge is full, or has a predetermined supply of fluid. In response to the indicator, the rejuvenation station turns on, turns off, or remains on or remains off, as appropriate. In one embodiment, the indicator 107 is audio. In another embodiment, alternatively or additionally the indicator is visual, such as a light turning on.

In another embodiment, the indicator 107 is a timer. The length of time set for the timer is determined using a standard length of time to reach the equilibrium or end cycle of the rejuvenation station and the cartridge, when starting with an emptied cartridge. For example, the timer indicates that a certain amount of time has passed and the pump is automatically turned off. Alternatively, the pump remains on until manually turned off.

In the embodiment illustrated, the rejuvenation station 100 has a service station 120. In the service station 120, a printhead 40 of the cartridge 14 is serviced with wiping to remove fluid and debris from the printhead, cleaning with a lubricant (wet wiping), spitting or firing a resistor in the printhead, using suction cups to reprime nozzles, and capping to keep the nozzles from drying out. In one embodiment, the service station includes an additional wiper for the housing of the cartridge. Herein incorporated by reference are U.S. Pat. Nos. 4,853,717, 5,155,497, 5,585,826, 6,000,779, and 6,174,041.

In one embodiment, the pump is electrically powered (not shown). In another embodiment, power is also supplied to the service station 120 to service the printheads. In another embodiment, the pump is manually powered (not shown).

In one embodiment, the fluid reservoir 110 is held in the rejuvenation station in the docking area 106 until release button 105 is pressed. Alternatively or additionally, the cartridge 14 is held in the rejuvenation station in the docking area 104 until release button 103 is pressed. In one embodiment, the release button 103 or 105 is coupled with a holder, such as a lever or a hook, that couples the cartridge 14 or the reservoir 110, respectively, to the station 100. Upon activating the release button 103 or 105, the cartridge 14 or reservoir is released from the docking station 104 or 106, respectively.

Figure 9:
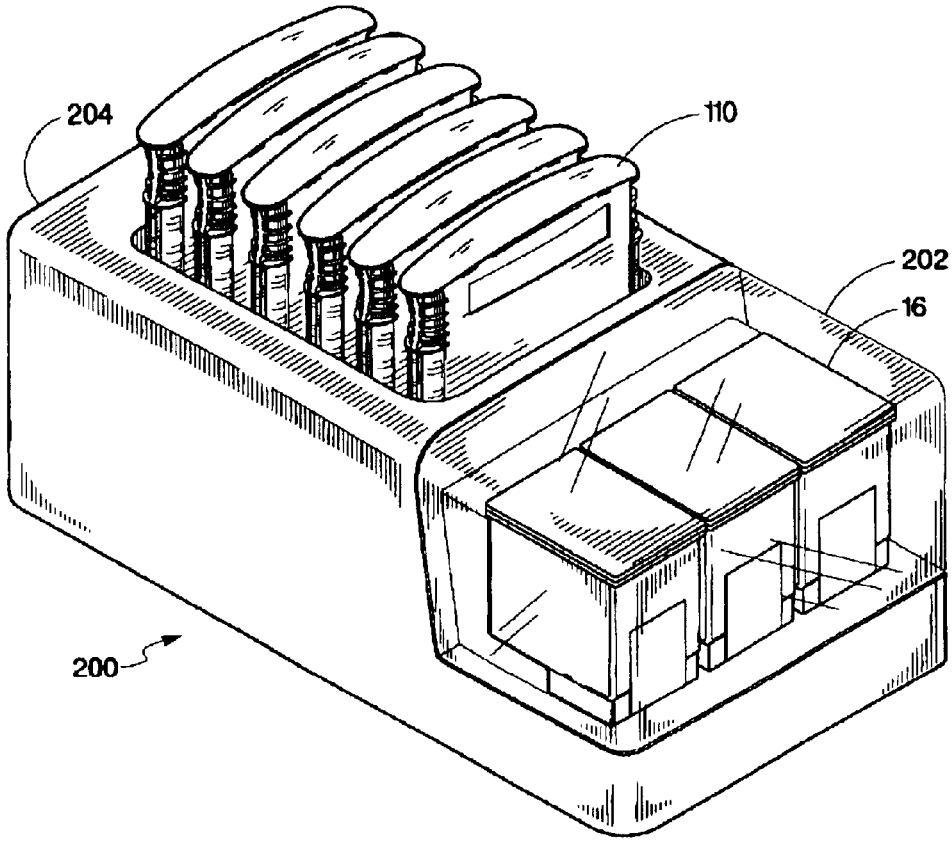
FIG. 9 illustrates a perspective view of an alternative rejuvenation station.

In one embodiment, the rejuvenation station has a safety mechanism that does not allow the cartridge to be removed from the rejuvenation station while the pump is in operation. When the pump is in operation, activation of the release button inactivates the pump 116. The release button 103 may also be a release door (such as lid 202 as shown in FIG. 9, which is later described). In another embodiment, the pump automatically turns off when the cartridge 14 is removed from the station 100. In yet another embodiment, a safety mechanism prevents fluid spillage in an event of premature removal of at least one of the printer cartridge and the fluid supplier.

Printhead Cartridge

Figure 3A:
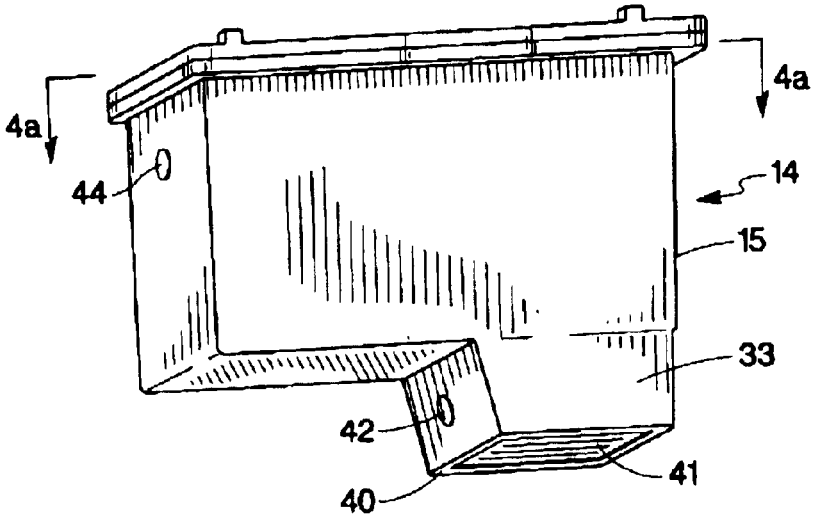
FIG. 3*a* illustrates a perspective view of a single color inkjet cartridge of the present invention.

Referring to FIG. 3*a*, the printhead cartridge 14 includes a generally rectilinear enclosure or housing 15 made of plastic or another hard, impervious material. In one embodiment, the housing 15 of the cartridge 14, as well as the housing of the cartridge 16, are both substantially similar to one of the conventional inkjet cartridges, such as the inkjet cartridges that are used in Hewlett Packard's line of Deskjet printers. Accordingly, the cartridges 14 and 16 are usable in Hewlett-Packard's line of Deskjet printers.

The printhead 40 of the cartridge 14 is located on an underside of the cartridge adjacent a standpipe section 33. A rear wall (not shown) of cartridge 14 includes a contact pad (not shown) containing numerous electrical contacts for completing electrical connections with the printer. The printhead and electrical contacts are standard features of ink-jet printhead cartridges.

Figure 4A:
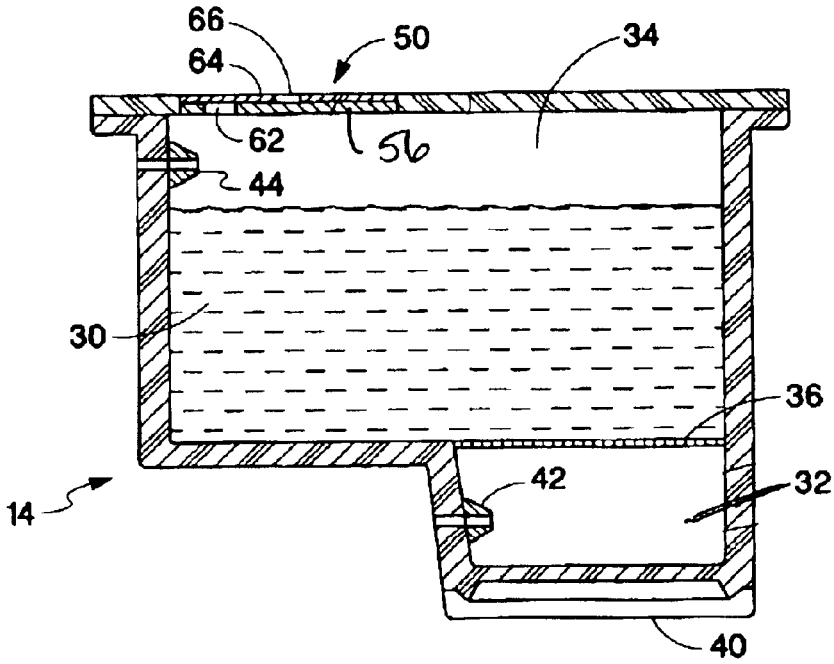
FIG. 4*a* illustrates a cross-sectional view of the inkjet cartridge through section 4*a*—4*a* of FIG. 3*a;*

As shown in FIGS. 3*a* and 4*a*, the cartridge 14 has two main chambers which are separated by a filter 36: a capillary chamber 30 and a filtered chamber 32. The filtered chamber is enclosed in the standpipe section 33 of the cartridge 14. The capillary chamber 30 encompasses the majority of the interior volume of cartridge housing. In one embodiment, the filter 36 is permeable to fluid, but not to air or gasses.

In some embodiments, air or gas is mixed with the fluid in the printer cartridge and in the fluid reservoir, and may be recirculated in the system. As discussed in the background, it is not desirable for air to remain in the cartridge. In one embodiment, a mechanism for purging the air from the system is installed, as described in more detail below. In this embodiment, the fluid is recirculated throughout the system, while the air accumulates into and purges from the mechanism.

In this embodiment, the fluid with the air or gas is inserted into the capillary chamber 30. The fluid moves through the filter 36 into the filtered chamber 32 of the standpipe section 33, while the air separates from and moves to a location over the fluid in the capillary chamber 30, thereby creating a humid chamber 34. When the pump 116 operates to suck the fluid from the filtered chamber 32, fluid and/or air is moved through the fluid path in the system. In one embodiment, when the cartridge is at least partially depleted, air or gasses may pass through the filter or be sucked through the filter into the filtered chamber by the pump, and then possibly sucked into the pressure chamber. In this embodiment, as explained above, the reservoir valve 128 may open during the cycle to add fluid to the pressure chamber. In the equilibrium or end state of the system, fluid moves through the fluid path, and air remains in the humid chamber. Excess air is purged from the purging mechanism as described below.

In order to absorb and hold fluid in capillary chamber 30, capillary chamber 30 is customarily filled with an absorbent foam. The foam also prevents the fluid from flowing freely and in an uncontrolled manner through the printhead nozzles 41 on the underside of the cartridge. The foam maintains a slight negative pressure (i.e., below ambient pressure) which retains the fluid in the capillary chamber 30 until the fluid is deposited on a media in a controlled manner.

A further alternative mechanism for maintaining negative pressure within the capillary chamber 30 is to use glass beads, or any other capillary media. In one embodiment, the fluid replenishing system of the present invention is capable of being used in any cartridge which is provided with the fluidic interconnects 42, 44 which is designed to receive fluid and direct it to the capillary chamber 30, without regard to the operative internal structure of the capillary chamber 30.

In one embodiment, the entrance fluidic interconnect (or refill port) 44 is a partially plugged circular opening, or can alternatively be a one-way valve, incorporating the valve 148. The refill port 44 allows fluid to flow into the capillary chamber 30 from the entrance fluidic interconnect 144. In one embodiment, the fluidic interconnects are a needle and a septum, or a resilient sealing ring. The sealing ring mates with the refill interconnect 44 and also helps confine and direct any fluid delivered by the replenishing system of the rejuvenation station 100 into the capillary chamber 30. In another embodiment, the fluidic interconnect is a foam filter (not shown), or a fluidic interconnect known in the medical industry.

In one embodiment, the cartridge 14 further has a labyrinth (or an air purge mechanism) 50 adjacent the capillary chamber 30. In an upper area in the capillary or pressurized chamber 30 is the humid chamber 34. The foam in the capillary chamber operates as an air/fluid separator. The air bubbles move toward the humid chamber 34 thereby separating from the fluid. Accordingly, the air in the chamber 30 is in the humid chamber 34. The air bubbles then move to the air purge mechanism 50 to be purged from the cartridge into the atmosphere.

As shown in FIG. 4*a*, the air purge mechanism 50 has a lid member 56. The lid member 56 includes a through port 62. A cap member or top plate 64 (shown in a partially cutaway depiction) is mounted superjacent the lid member 56. The cap member 64 also has a port 66 and the two ports 62, 66 are coupled through a labyrinth 68, as described below, with reference to FIG. 5*a*.

Figure 5A:
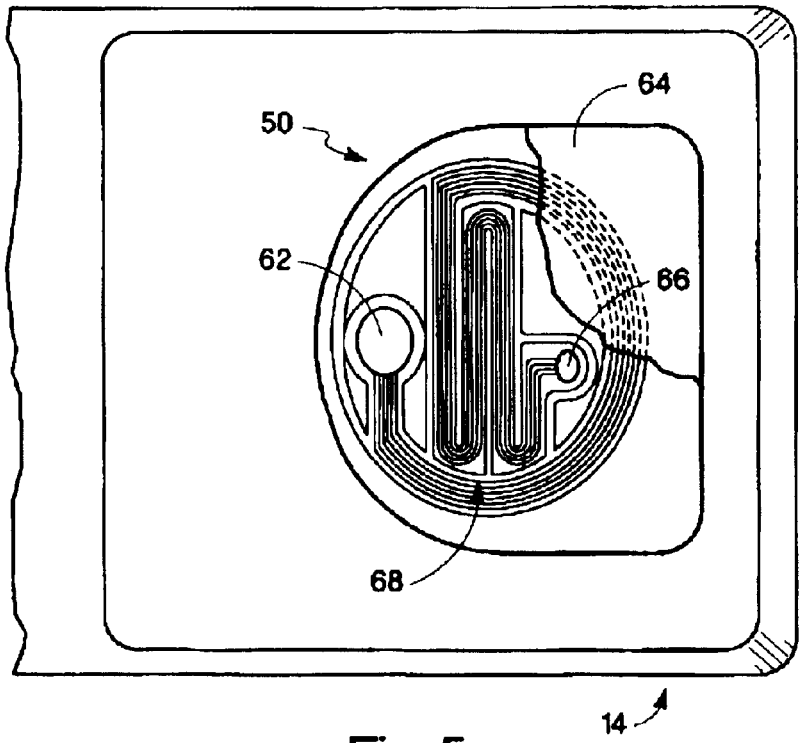
FIG. 5*a* illustrates a top view of the cartridge of FIG. 4*b;*

To prevent undesired air from entering into the cartridge 14, 16 and to minimize the evaporation of ink from the pen, the lid member 56 includes the labyrinth 68 which serves as a vapor barrier. As shown in FIG. 5*a*, the labyrinth 68 is a twisted passage path through which ambient air must travel before entering the cartridge via port 62. The ratio of the cross-sectional area to length of the labyrinth 68 should be such that the volume of gas within effectively slows convective mass transfer. The appropriate dimensions of the labyrinth 68 for any particular cartridge embodiment is empirically determined by a person skilled in the art using Fick's Laws of Diffusion.

A first end of the labyrinth opens to the port 62 of the lid member 56; a second end of the labyrinth opens to the ambient atmosphere via port 66. Humidity within the labyrinth varies along its length from a high value near the port 62 to approximately that of ambient atmosphere near the port 66. This humidity gradient serves to shield the ink from direct contact with ambient air. Herein incorporated by reference is U.S. Pat. No. 5,841,454, issued Nov. 24, 1998.

Figure 3B:
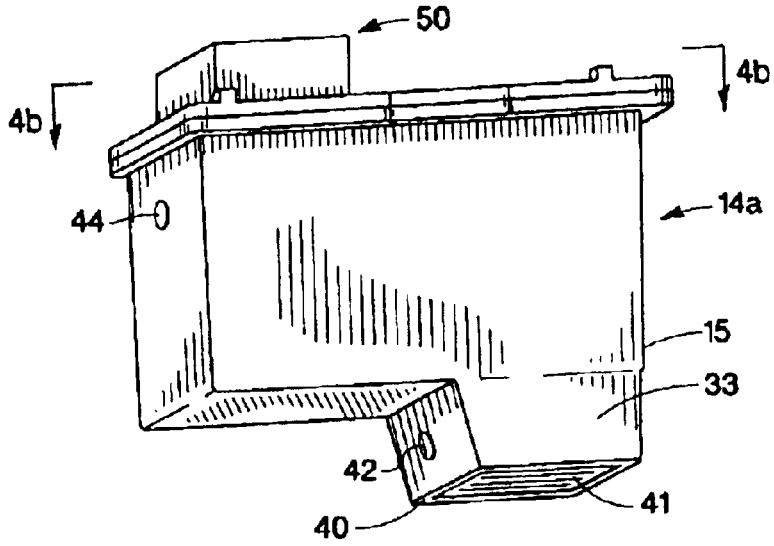
FIG. 3*b* illustrates a perspective view of another embodiment of the single color inkjet cartridge of the present invention.
Figure 4B:
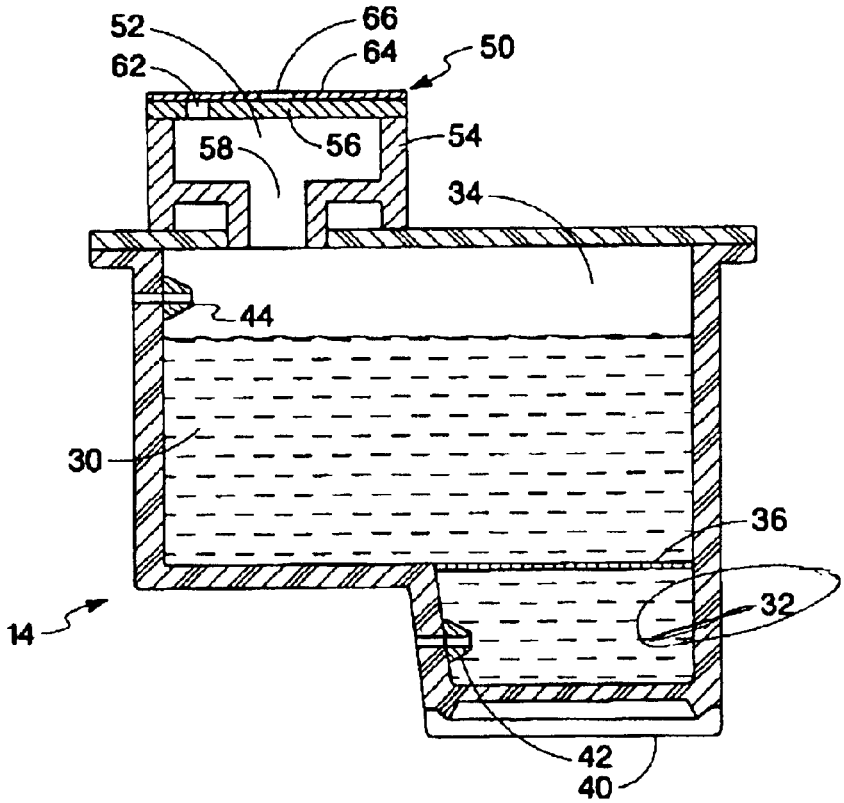
FIG. 4*b* illustrates a cross-sectional view of the cartridge through section 4*b*—4*b* of FIG. 3*b;*

The embodiment shown in FIGS. 3*b* and 4*b* illustrates an alternative printer cartridge 14*a* with an alternative air purge mechanism 50. The printer cartridge 14*a* is capable of being placed into the rejuvenation station 100. The printer cartridge 14*a* has a pressure regulator (not shown), which is an alternative mechanism for maintaining negative pressure within the chamber 30.

As shown in FIG. 4*b*, the air purge mechanism 50 in this embodiment further has a separator chamber 52 formed by walls 54 and the lid member 56. The separator chamber 52 includes a passageway 58 that couples to the humid chamber 34 inside of the cartridge. The labyrinth 68 and the chamber 52 are capable of acting as the air/fluid separator in this embodiment.

The printer cartridge of FIG. 4*b* further has a mesh screen (or membrane) 60 additionally mounted in the air purge mechanism 50. In one embodiment, the mesh screen acts as an air/ink separator. The mesh screen 60 is mounted such as by a press-fit, a heat stake, an ultrasonically weld, an adhesive mounting, or the like, as would be known in the art. The membrane 60 is located in the passageway 58 proximate the humid chamber 34. In one embodiment, the mesh screen 60 has an approximately twelve micron mesh and is fabricated of a material, such as stainless steel, that does not react with liquid ink is suited to the operation of the present invention. The mesh screen 60 acts as a bubble generator in that a meniscus of ink forms over each aperture of the mesh due to the surface tension of the ink and a differential pressure will then pull the gases past these menisci. The differential pressure is determined by the surface tension of the ink, the size of the apertures, and the contact angle of the ink with the mesh. A suction device (not shown) is placed on cap member or top plate 64 of the air purge mechanism to suck the air and gasses through the membrane 60. In this embodiment using the internal pressure regulator, the exit fluidic interconnect 42 may be located in an area other than the standpipe section 33 of the cartridge.

Figure 5B:
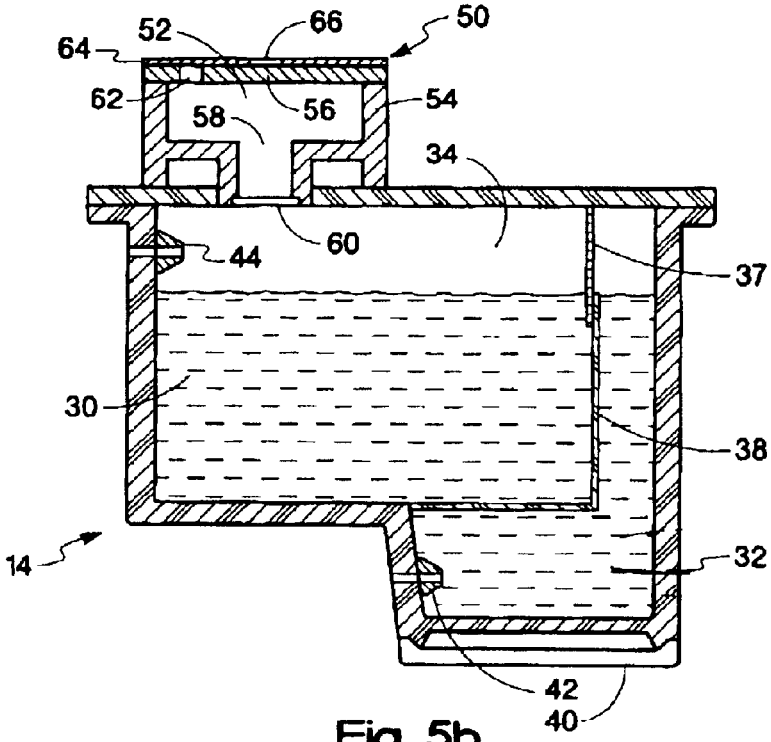
FIG. 5*b* illustrates a cross-sectional view of an alternative inkjet cartridge through section 4*a*—4*a* of FIG. 3*a;*

FIG. 5*b* illustrates the printer cartridge 14 of FIG. 3*a*, with a pressure regulator (not shown) in the chamber 30. The chamber 30 is separated from L-shaped filtered chamber 32 by a barrier 38 and a vertical filter 37. The vertical filter 37 operates in a similar manner to the filter 36 described previously. The filtered chamber 32 has a narrow vertical channel into which fluid, including air, flows from the chamber 30 through the filter 37. The fluid, including air, flows toward the bottom of the filtered chamber 32 to be ejected from the printhead or be recirculated through the rejuvenation station, as desired. As the fluid level in the chamber 30 decreases to a top of the barrier 38, the fluid no longer flows to the filtered chamber through the filter, as shown in FIG. 5*b*.

An alternative mechanism for purging air from the cartridge includes purging air through the nozzles 41. The air is sucked, pulled or pushed out of the cartridge through a variety of means. For instance, the air is purged using the service station 120, in particular, spitting or firing a resistor in the printhead, and using suction cups to reprime nozzles.

Figure 6A:
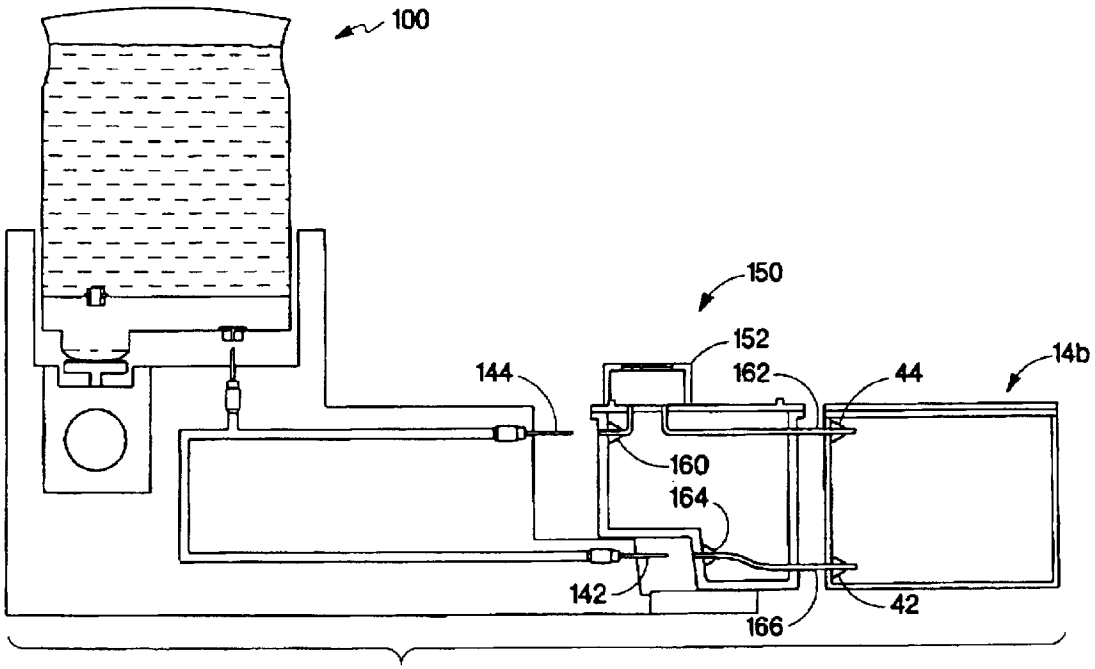
FIG. 6*a* illustrates an expanded view of the rejuvenation station with an adaptor and an inkjet cartridge.
Figure 6B:
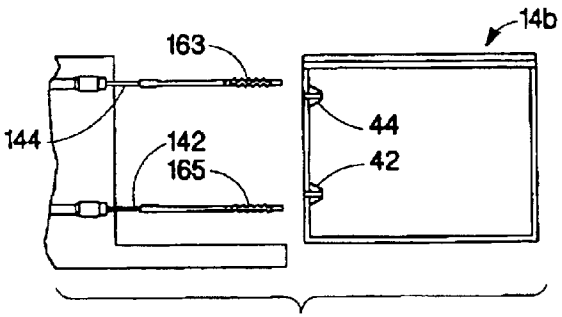
FIG. 6*b* illustrates an alternative embodiment of the adaptor of FIG. 6*a;*

FIG. 6*a* shows an exploded view of the rejuvenation station 100 with an adaptor 150. The adaptor 150 couples a cartridge 14*b* with the rejuvenation station 100. The cartridge 14*b* is an existing cartridge for a printer. The adaptor 150 and the cartridge 14*b* are capable of taking a variety of shapes, determined by printer characteristics and compatibility. The shapes of the cartridge and the adaptor in FIGS. 6*a* and 6*b* are for illustrative purposes only.

As shown, the adaptor has fluidic interconnects 160 and 164 to connect with rejuvenation station fluidic interconnects 144, 142, respectively. Further, the adaptor has fluidic interconnects 162 and 166 to connect with cartridge fluidic interconnects 44, 42, respectively. In one embodiment, the adaptor 150 has an air purge mechanism 152 that operates in a similar manner as air purge mechanism 170 described below with respect to FIG. 7*a*.

The adaptor 150 is configured to be associated with the cartridge 14*b*. For example, the fluidic interconnects 162, 166 are designed to be adapted to couple with and line up with the fluidic interconnects 44, 42. Alternatively, as shown in FIG. 6*b*, the adaptor 150 includes the flexible tube connectors 163, 165. In this instance, the connectors 163, 165 are able to be maneuvered to the connectors 44, 42 on the cartridge 14*b*, respectively, regardless of the cartridge shape and size.

Figure 7A:
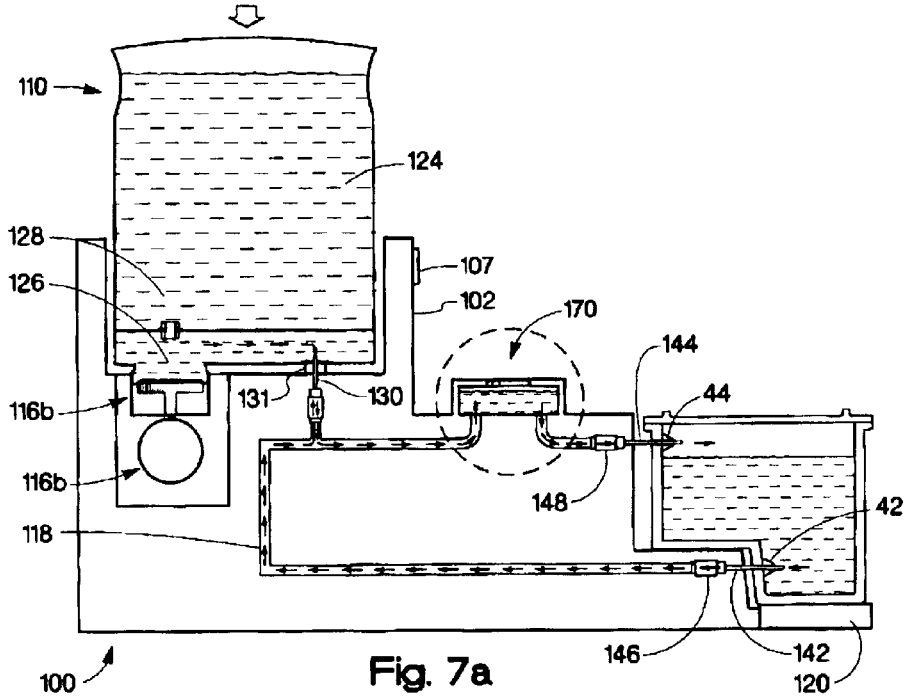
FIGS. 7*a* to 7*c* illustrate an alternative embodiment of the rejuvenation station of the present invention.
Figure 7B:
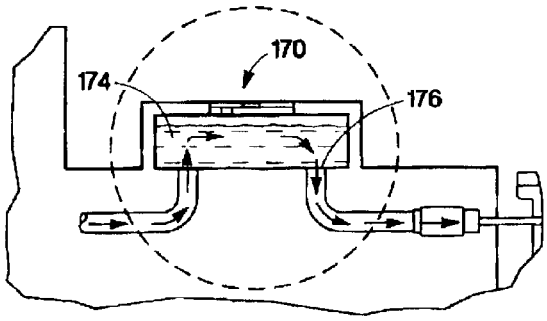
Figure 7C:
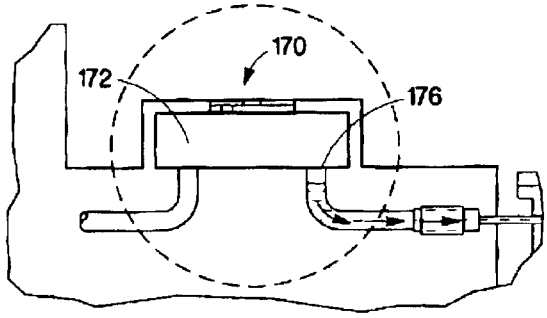

In FIG. 7*a*, the rejuvenation station 100 has an air purge mechanism 170. In one embodiment, the mechanism 170 operates in a similar manner as air purge mechanism 50 described above with respect to FIG. 4*a* or 4*b*. When the rejuvenation station is in operation, and fluid is flowing in the fluid path 118 towards the entrance fluidic interconnect 144, air is purged from the fluid path 118 at the air purge mechanism 170, as shown in FIGS. 7*b* and 7*c*.

The air purge mechanism 170 has a screen or a membrane 176 that acts as a filter for the tube between the air purge mechanism 170 and the entrance fluidic interconnect. The membrane 176 is permeable to the fluid, and impermeable to the air or gasses. In this embodiment, the air cannot break the meniscus on the membrane 176. In operation, fluid 174 moves through the fluid path 118 and into the air purge mechanism 170. Fluid 174 is allowed to escape the air purge mechanism back into the fluid path 118 towards the entrance fluidic interconnect 144, but the air 172 remains behind, as shown in FIG. 7*c*. In one embodiment, the air escapes through the labyrinth in an upper wall of the mechanism 170.

In an alternative embodiment, the air purge mechanism 170 operates similar to the cartridge and air purge mechanism of FIG. 4*a*. In particular, the mechanism 170 includes a container (not shown) enclosing foam. The container couples the fluid circuit 118 in the station 100. Fluid, including air, is poured onto foam from the pressure chamber and the fluid circuit 118. The foam acts as an air/ink separator, and the air is purged from the labyrinth. The fluid exits the container through the tube 118 at the bottom of the container. The tube of the fluid circuit 118 continues from the bottom of the container to the entrance fluidic interconnect.

Figure 8:
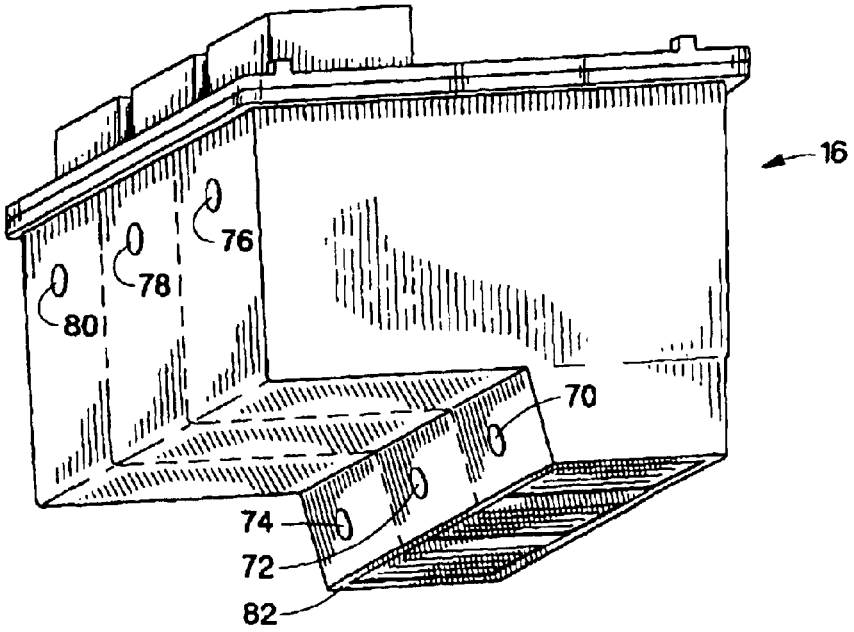
FIG. 8 illustrates a perspective view of a multi-color inkjet cartridge of the present invention.

In FIG. 8, the tricolor cartridge 16 includes three separate capillary chambers (not shown) and their associated filtered chambers, each of which supplies a predetermined fluid to a tricolor printhead 82. The cartridge 16 has a configuration of the coupling conduits or fluidic interconnects 70, 76; 72, 78; and 74, 80 that correspond with the three filtered and capillary chambers, respectively. Each pair of fluidic interconnects 70, 76; 72, 78; and 74, 80 are associated with a separate reservoir 110, as shown in FIG. 9. In one embodiment, each reservoir 110 is a different fluid color or composition, having a distinctive fluid composition or a distinctive fluid color as compared with the other reservoirs in the rejuvenation station. The fluid color or fluid composition of the reservoir corresponds to the desired (or initial) fluid color or composition of the cartridges. Other than the provision of three separate capillary chambers, the three pairs of fluidic interconnects, and the internal plumbing of the cartridge which carries the three fluids to the printhead 82, cartridge 16 closely resembles monochrome cartridge 14 described above in connection with FIG. 3.

Alternatively, the cartridge 14 or 16 is a four fluid or four color printhead, with inks, such as a cyan ink, a magenta ink, a yellow ink, and a black ink. In another alternative embodiment, the cartridge 14 or 16 is a six fluid or six color printhead, adding two additional fluids, such as light cyan ink, and light magenta ink. The black ink in the above embodiments is one of a pigment based black or a dye based black. In yet another alternative embodiment, the cartridge 14 or 16 is a seven fluid or seven color printhead, with an additional ink, such as another black ink, either the pigment based black or the dye based black, as desired.

As shown in FIG. 9, a rejuvenation station 200 has a housing 204, and a lid 202 covering the cartridges 14, 16 which are inserted into a docking area of the rejuvenation station 200. A plurality of reservoirs 110 are inserted into the housing 204 and are each associated with a pair of fluidic interconnects (not shown) in the rejuvenation station 200. The rejuvenation station 200 and method for refilling tricolor printhead cartridge 16 is similar to the above-described rejuvenation station 100 and the procedure for refilling monochrome cartridge 14.

The main difference between the rejuvenation station 100 and the rejuvenation station 200 is the number of reservoirs 110, and their associated fluidic interconnects (not shown). The reservoirs 110 are each associated with a separate cartridge 14, and/or separate capillary and filtered chambers within the same cartridge 16. Each pair of fluidic interconnects in the rejuvenation station 200 correspond with the pair of fluidic interconnects of the cartridge 14 or one of the three pairs of fluidic interconnects of the cartridge 16. In one embodiment the reservoirs have different fluids (e.g. colors or composition), that correspond with the fluid in the associated cartridge 14 or in the associated capillary chamber (for the cartridge 16).

Figure 10:
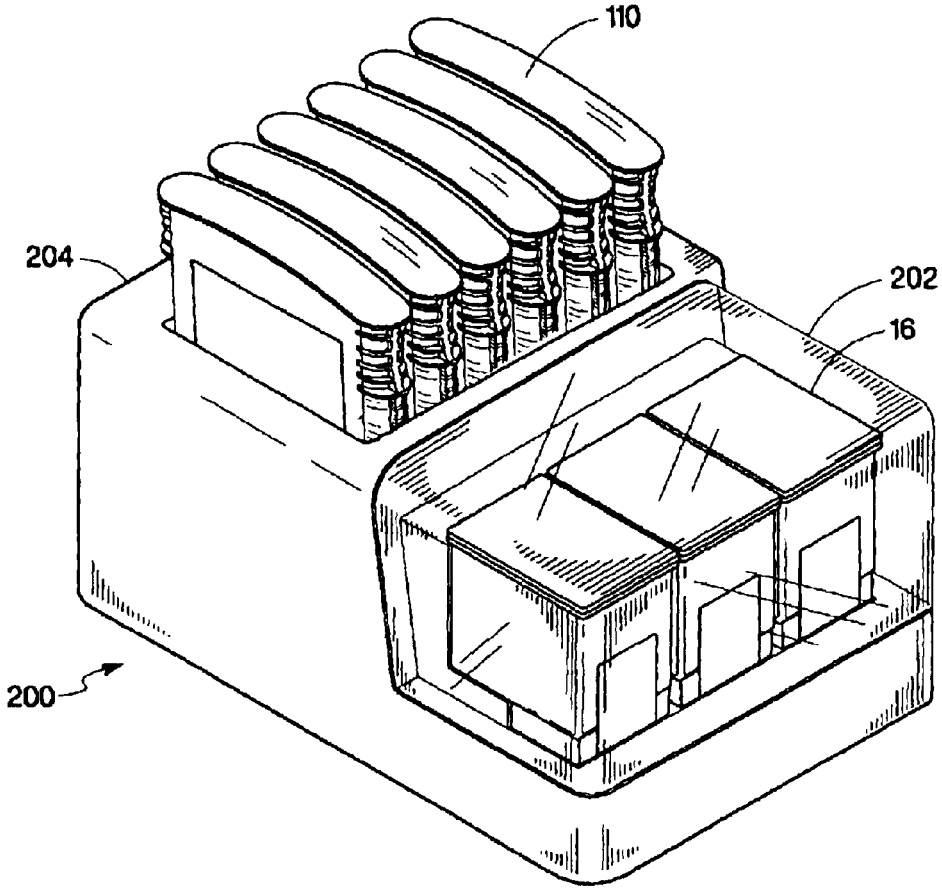
FIG. 10 illustrates a perspective view of another alternative embodiment of the rejuvenation station of the present invention.

FIG. 10 illustrates an embodiment of the rejuvenation station 200. The reservoirs 110 are oriented parallel with the cartridges 16, as opposed to perpendicular to the cartridges as shown in FIG. 9. The advantage of this embodiment over the embodiment of FIG. 9 is that the fluid path (not shown) from each reservoir to the fluidic interconnects (not shown) for the cartridges is shorter and more direct overall for each reservoir 110. The reservoirs 110 and cartridges 14, 16 may be oriented in various ways. However, an embodiment that compactly and efficiently holds the reservoirs and cartridges is desirable.

Figure 11:
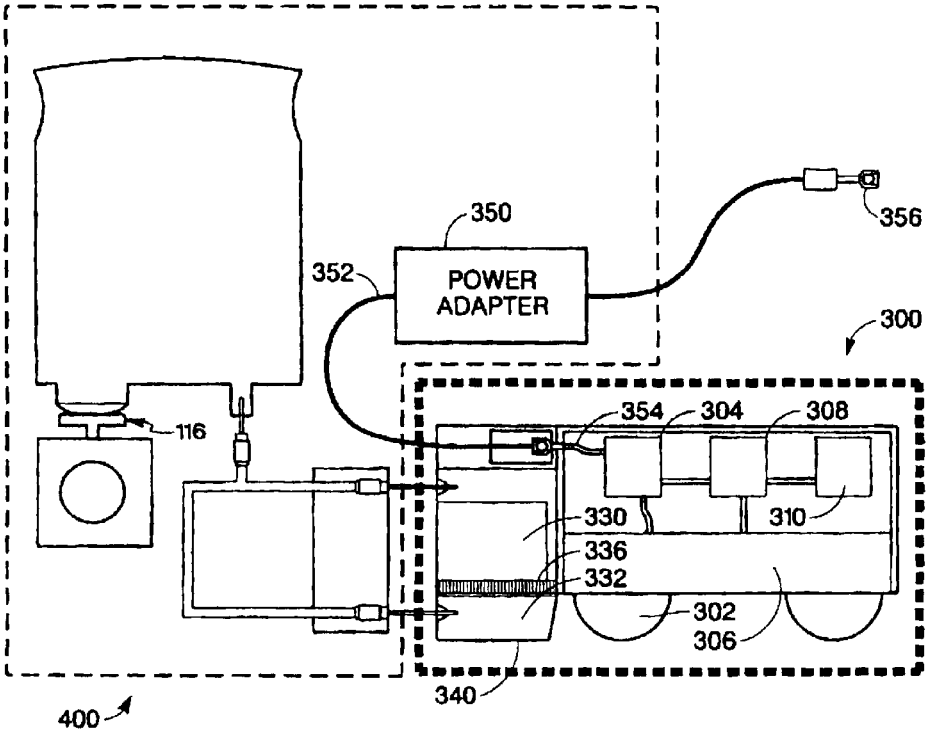
FIG. 11 illustrates a schematic view of yet another alternative embodiment of the rejuvenation station of the present invention rejuvenating a manual printer.

FIG. 11 illustrates a rejuvenation station 400 that rejuvenates a roving printer 300. The roving printer 300 has wheels or a roller 302, a power source 304, and a drive mechanism 306 coupled to the wheels to move the roving printer 300. In one embodiment, the power source 304 is a battery supplying power to the electronic components of the roving printer 10, such as the drive mechanism 306, and a printhead 340. The power supply can be eliminated if, alternatively, a cable is used to establish the communication link between the roving printer and a computer system (not shown). In one embodiment, the roving printer is manually maneuvered. In another embodiment, the roving printer is automatically maneuvered by the drive mechanism.

The battery 304 is coupled with a cable 354 that connects with a cable 352 of the rejuvenation station. The cable 352 provides power from a power adapter 350 to recharge the battery 304. The power adapter 350 couples with an electrical supply 356, such as 110 V.

The printhead 340 enables the roving printer to print on a surface. A capillary chamber 330 in the roving printer encloses a supply of print-forming material, such as ink, and a filtered chamber 332 supplies the material to the printhead 340 that deposits the print-forming material. In one embodiment, the printhead 340 and the capillary chamber 330 are part of a conventional inkjet cartridge, such as the inkjet cartridges that are used in Hewlett Packard's line of Deskjet printers. In this embodiment, the fluidic interconnects of the rejuvenation station are similar to the fluidic interconnects described above with reference to FIG. 2*a*.

In one embodiment, the capillary chamber 330 contains only black ink, for grayscale printing. Alternatively, there are four chambers 330, each containing one of cyan, magenta, yellow, and black ink, for color printing. In one embodiment, the fluid is instant-drying such that the contact between the roving printer and the fluid does not smudge the medium (not shown) on which the material is printed. For the embodiment where there are multiple capillary chambers 330 in the roving printer, the reservoirs of the rejuvenation station are configured similar to those shown and described in FIG. 10.

In one embodiment, the roving printer 10 has a processor 308. The principal function of the processor 308 is to acquire the data from various components of the roving printer in ways that correspond to a mode of operation of the roving printer. In one embodiment, the processor 308 is coupled to an interface (not shown) with the computer system. The processor 308 signals software in a main processor (not shown) of the computer system of the operation that is occurring, such as moving and printing. The processor 308 is coupled with the printhead 340, with the drive mechanism 306 moving the roving printer, and with the power source 80 to which the processor indicates to provide power to the printhead 340 and drive mechanism 306.

In one embodiment, the processor 308 is coupled with a memory (not shown) in the roving printer. In one embodiment, the memory stores printer driver software pre-programmed to convert the image data to print data and drive the drive mechanism for the printhead 340. In another embodiment, the memory is coupled to read-only memory (not shown) that is programmed with the printer driver software.

In an alternative embodiment, the roving printer 300 does not contain the processor 308 and the memory. The functions of the processor 308 and the memory are performed by the computer system. However, the printing operation of the roving printer in this embodiment functions in the same manner as described below.

The roving printer further has a location system 310. The location system 310 enables the roving printer to determine a location relative to a medium in order to adequately print image data to a sufficient quality. The location system 310 is coupled with the processor 308 and provides the processor with location information. The interface is wireless transmitted in a form of infrared or radio frequency signals, or alternatively via the cable.

The rejuvenation station 400 protects the roving printer 300 during transportation and environmentally, as well as refills fluid in the roving printer, recharges the battery, purges air, and services the printhead. The rejuvenation station allows for maintenance and safe transportation of the roving printer, acting as a garage during transportation of the printer. The rejuvenation station is a rugged structure that acts to prevent damage of the printer during transportation, and to protect the printer from altitude excursions, temperature changes and humidity.

Figure 12:
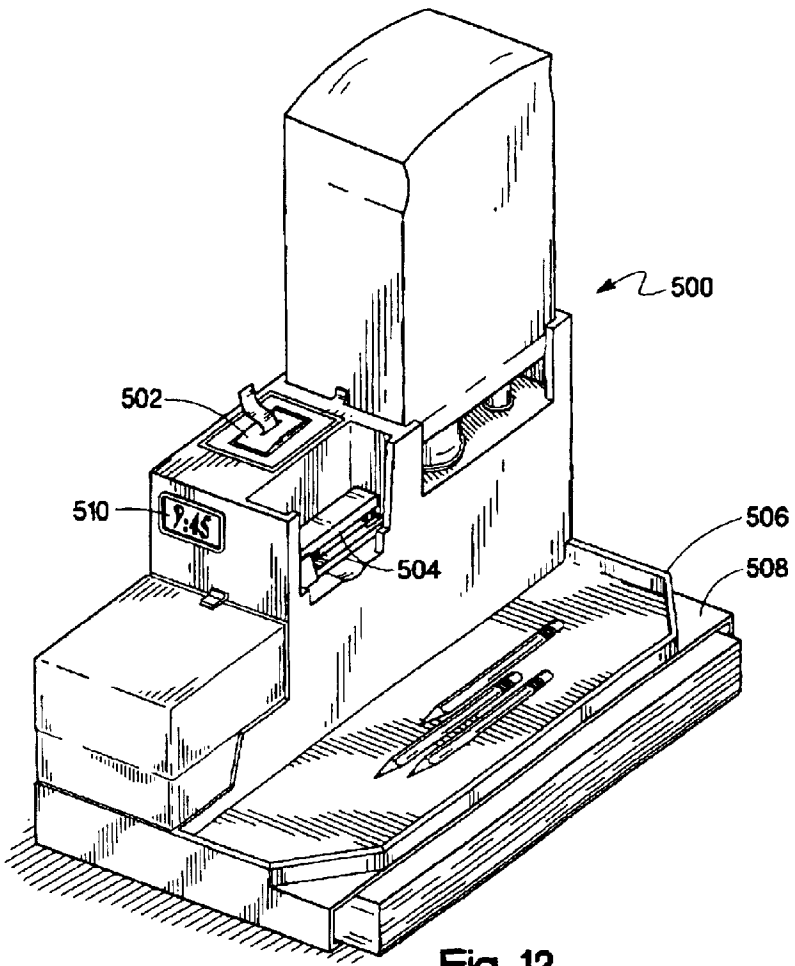
FIG. 12 illustrates another alternative embodiment of the rejuvenation station of the present invention.

FIG. 12 illustrates an embodiment of a rejuvenation station 500. In addition to the components of the rejuvenation station 100 of FIG. 2*a*, the rejuvenation station 500 also has utility mechanisms. The utility mechanisms include a tape dispenser 502, a stapler 504, a writing utensil holder 506, a media holder 508, and a clock 510. Other utility mechanisms that are convenient to the user in a desk environment are also part of the invention.

The present invention serves to extend the life of printhead cartridges used on ink-jet printers by allowing for convenient replenishment of the ink in the ink reservoir and servicing of the printhead. In so doing, the invention helps reduce the expense and waste of having to dispose of a printhead cartridge whenever the ink is exhausted. The system eliminates the user's exposure to ink during refilling, prevents messy spillages and overfilling, and is compatible with existing printhead cartridges if they are equipped with fluidic interconnects as described above.

While the present invention has been disclosed with reference to the foregoing specification and the preferred embodiment shown in the drawings and described above, it will be apparent to those skilled in the art that changes in form and detail may be made therein without departing from the spirit and scope of the invention as defined by the appended claims.

What is claimed is:

1. A rejuvenation station for a printer cartridge comprising:

a housing with a first area adapted to hold a fluid supplier, and a second area adapted to hold the printer cartridge;

a first fluidic interconnect in the first area, wherein the first fluidic interconnect is adapted to couple with the fluid supplier;

a second fluidic interconnect in the second area, wherein the second fluidic interconnect is adapted to couple with the printer cartridge;

a fluid path in the housing that couples the fluidic interconnects; and an actuator extracting fluid from the printer cartridge, and inserting fluid into the printer cartridge through the fluid path.

2. The rejuvenation station of claim 1 wherein the first area is formed to hold a plurality of fluid suppliers.

3. The rejuvenation station of claim 2 further comprising a plurality of fluid reservoirs held in the first area of the housing, wherein each fluid reservoir is capable of having a fluid with at least one of a distinctive composition and a distinctive color.

4. The rejuvenation station of claim 3 further comprising a plurality of printer cartridges held in the second area of the housing, wherein each printer cartridge has a certain color and a certain composition, wherein each printer cartridge has a corresponding fluid reservoir with substantially the same certain color and substantially the same certain composition, wherein the printer cartridge is fluidically coupled with the corresponding fluidic reservoir.

5. The rejuvenation station of claim 1 wherein the second area is formed to hold a plurality of printer cartridges.

6. The rejuvenation station of claim 1 further comprising an adaptor coupled with the second area and with the second fluidic interconnect, wherein the adaptor is capable of coupling with the printer cartridge.

7. The rejuvenation station of claim 6 wherein the adaptor has flexible connectors to fluidically couple with the printer cartridge.

8. The rejuvenation station of claim 1 further comprising an air purge mechanism.

9. The rejuvenation station of claim 1 further comprising a service station that is capable of servicing a printhead of the printer cartridge.

10. The rejuvenation station of claim 1 further comprising a safety mechanism that prevents fluid spillage in an event of premature removal of at least one of the printer cartridge and the fluid supplier.

11. The rejuvenation station of claim 1 further comprising a utility mechanism.

12. The rejuvenation station of claim 11 wherein the utility mechanism is at least one of a media holder, a writing utensil holder, a tape dispenser, a stapler, and a clock.

13. A printer cartridge and a rejuvenation station for the printer cartridge comprising:

a housing of the rejuvenation station with a dock that is capable of receiving the printer cartridge;

a first pair of corresponding fluidic interconnects coupling the rejuvenation station and the printer cartridge;

a second pair of corresponding fluidic interconnects coupling the rejuvenation station and the printer cartridge; and a fluid path in the housing, wherein the fluidic interconnects are coupled via the fluid path, wherein the first and second pair of fluidic interconnects engage to create a fluid circuit in the fluid path.

14. The printer cartridge and rejuvenation station of claim 13 wherein the printer cartridge is a component of a roving printer.

15. A rejuvenation station for a fluid ejection device comprising:

a housing with a first area adapted to hold a fluid supplier, and a second area adapted to hold the fluid ejection device;

a first fluidic interconnect in the first area, wherein the first fluidic interconnect is adapted to couple with the fluid supplier;

a second fluidic interconnect in the second area, wherein the second fluidic interconnect is adapted to couple with the fluid ejection device;

a fluid path in the housing that couples the fluidic interconnects; and an actuator extracting fluid from the fluid ejection device, and inserting fluid into the fluid ejection device through the fluid path.

16. The rejuvenation station of claim 15 wherein the actuator extracts fluid from the fluid supplier.

17. A fluid ejection cartridge and a rejuvenation station for the fluid ejection cartridge comprising:

a housing of the rejuvenation station with a dock that is capable of receiving the fluid ejection cartridge;

a first pair of corresponding fluidic interconnects coupling the rejuvenation station and a fluid supplier;

a second pair of corresponding fluidic interconnects coupling the rejuvenation station and the fluid ejection cartridge; and a fluid path in the housing, wherein the fluidic interconnects are coupled via the fluid path, wherein the first and second pair of fluidic interconnects engage to create a fluid circuit in the fluid path.

18. The fluid ejection cartridge and the rejuvenation station of claim 17 wherein the fluid ejection cartridge is a component of a roving printer.

19. The fluid ejection cartridge and the rejuvenation station of claim 18, wherein the rejuvenation station has a docking station that is capable of storing the roving printer.

* * * * *